US006668393B1

(12) United States Patent
Mascari et al.

(10) Patent No.: US 6,668,393 B1
(45) Date of Patent: Dec. 30, 2003

(54) HEIGHT ADJUSTABLE DIVERTER SPOUT ASSEMBLY

(75) Inventors: Nicholas A. Mascari, Newburgh Heights, OH (US); Martin Zummersch, Lakewood, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 10/200,914

(22) Filed: Jul. 23, 2002

(51) Int. Cl.[7] ..... E03C 1/04
(52) U.S. Cl. ..... 4/678; 4/695
(58) Field of Search ..... 4/675, 678, 695, 4/696; 137/119.3, 119.4, 119.5, 359

(56) References Cited

U.S. PATENT DOCUMENTS

| | | | | | |
|---|---|---|---|---|---|
| 1,591,332 | A | * | 7/1926 | Mueller | 4/678 |
| 1,654,550 | A | * | 1/1928 | Muend | 137/359 |
| 1,728,492 | A | * | 9/1929 | Kaufman | 4/695 |
| 3,739,806 | A | | 6/1973 | Bucknell et al. | |
| 3,906,983 | A | | 9/1975 | Parkison | |
| 4,084,620 | A | | 4/1978 | Bucknell et al. | |
| 4,463,460 | A | * | 8/1984 | Arnold et al. | 4/678 |
| 4,662,389 | A | * | 5/1987 | Igbal | 4/695 X |
| 4,874,006 | A | | 10/1989 | Iqbal | |
| 5,031,877 | A | * | 7/1991 | Mercer | 137/359 X |
| 5,060,687 | A | | 10/1991 | Gayton | |
| 5,232,008 | A | | 8/1993 | Jeffress et al. | |
| 5,558,128 | A | | 9/1996 | Pawelzik et al. | |
| 5,845,670 | A | | 12/1998 | Life | |
| 5,901,735 | A | | 5/1999 | Breda | |
| 5,946,746 | A | | 9/1999 | Bloom | |
| 5,983,917 | A | | 11/1999 | Thomas | |
| 6,035,458 | A | | 3/2000 | Tarzia | |
| 6,138,296 | A | | 10/2000 | Baker | |
| 6,175,972 | B1 | | 1/2001 | Wales | |
| 6,195,818 | B1 | | 3/2001 | Rodstein et al. | |
| 6,256,810 | B1 | | 7/2001 | Baker | |

* cited by examiner

*Primary Examiner*—Robert M. Fetsuga
(74) *Attorney, Agent, or Firm*—Cook, Alex, McFarron, Manzo, Cummings & Melher, Ltd.

(57) ABSTRACT

A height adjustable water spout mounting assembly includes a sleeve having an external threaded surface for deck mounting the sleeve and an internal threaded surface. There is a spout interface formed and adapted to extend above the spout deck with an outer surface which is at least in part threaded and sized to extend within and have its exterior threads interact with the interior threads on the sleeve for relative height adjustment of the spout interface with the spout mounting deck. There is further a height adjustable diverter lift rod associated with the sleeve and spout interface.

13 Claims, 3 Drawing Sheets

HEIGHT ADJUSTABLE DIVERTER SPOUT ASSEMBLY

THE FIELD OF THE INVENTION

The present invention relates to roman tub faucets and more specifically to a faucet assembly which permits ease of height adjustment after the spout nipple has been installed to the deck of the roman tube. Additionally, the invention pertains to a diverter assembly which is also height adjustable, after the spout has been mounted to the tub deck.

Conventionally, during the rough-in assembly of the spout nipple to a roman tub deck the nipple will be attached to the deck through the use of a mounting nut which threads on the exterior of the nipple from below the tub deck. If subsequently a decorative surface is added to the tub deck, for example granite, marble, or some other decorative material, in the past it was necessary to remount the spout nipple to accommodate the increased thickness of the deck surface which will mount the roman tub spout. The present invention provides a mounting assembly for a roman tub faucet which is height adjustable after the spout nipple has been attached to the sink deck during the rough-in stage.

The mounting assembly includes the spout nipple with an exterior thread for mounting it to the tub deck. The inside of the spout nipple is at least in part threaded and there is a spout interface with an exterior thread. The exterior threads of the spout interface interact with the interior threads of the spout nipple permitted telescopic height adjustment to accommodate for variations in tub deck thickness after installation of the spout nipple.

The invention further provides an adjustable height diverter rod assembly. The diverter assembly extends down through the center of the spout interface and nonrotatably mounted in the diverter body. The upper end of the diverter rod includes a threaded socket and the lift rod includes a threaded end. After positioning of the spout on the spout nipple and onto the tub deck, the lift rod is placed through an opening in the spout and is threaded into the diverter rod to a height appropriate to the deck thickness, taking into account the position of the roman tub spout on the tub deck.

SUMMARY OF THE INVENTION

The present invention relates to a roman tub spout with an integral diverter and particularly to a roman tub spout assembly which is height adjustable after the rough-in stage.

More specifically, the present invention relates to a telescopic mounting assembly for a roman tub faucet spout which includes a spout nipple and a spout interface which is telescopically adjustable relative to the spout nipple, after the spout nipple has been attached to the roman tub deck.

Another purpose of the invention is to provide a simply constructed reliable roman tub mounting assembly which permits height adjustment at the spout location after the spout nipple has been attached to the tub deck.

Another purpose of the invention is a height adjustable diverter assembly for a roman tub spout Another purpose is to provide a diverter assembly in which the lift rod thereof may be height adjustable after the spout is attached to the sink deck.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
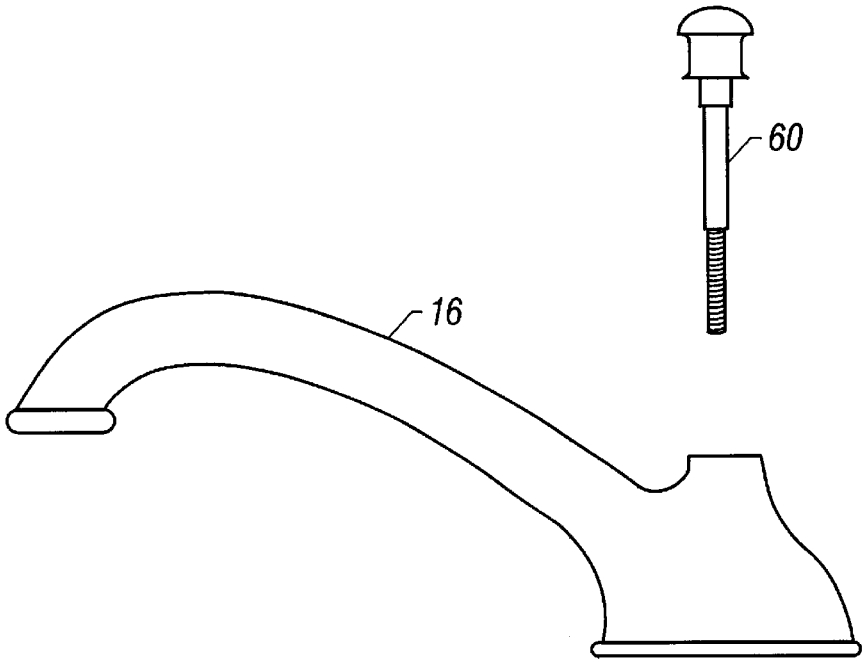
FIG. 1 is a side view illustrating the height adjustable diverter spout assembly of the present invention mounted to a sink deck.

In FIG. 1, the deck of a conventional roman tub is indicated at 10 and the height adjustable diverter spout assembly is indicated generally at 12 and is shown attached to the bottom of the deck through the use of a mounting nut 14. The diverter assembly extends through the sink deck and a spout 16 is shown mounted on the upper surface of the deck. The purpose of the present invention is to accommodate an increase in the thickness of the tub deck by the addition of a decorative surface to the top of the deck after the rough-in installation. What is shown in FIG. 1 is the rough-in installation, with the spout added on thereto, but without the addition of a decorative surface. Such an addition would require an adjustment in the height of the spout interface, as will appear in more detail hereinafter.

Figure 3:
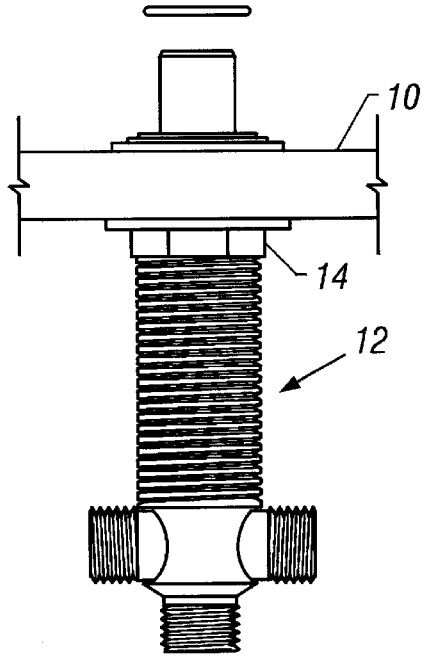
FIG. 3 is a top view of the diverter body.
Figure 3:
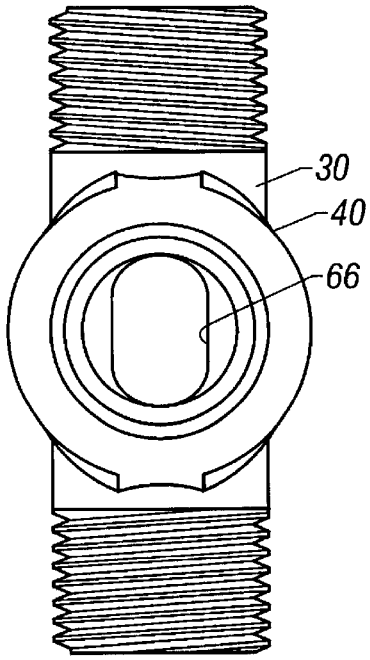
Figure 2:
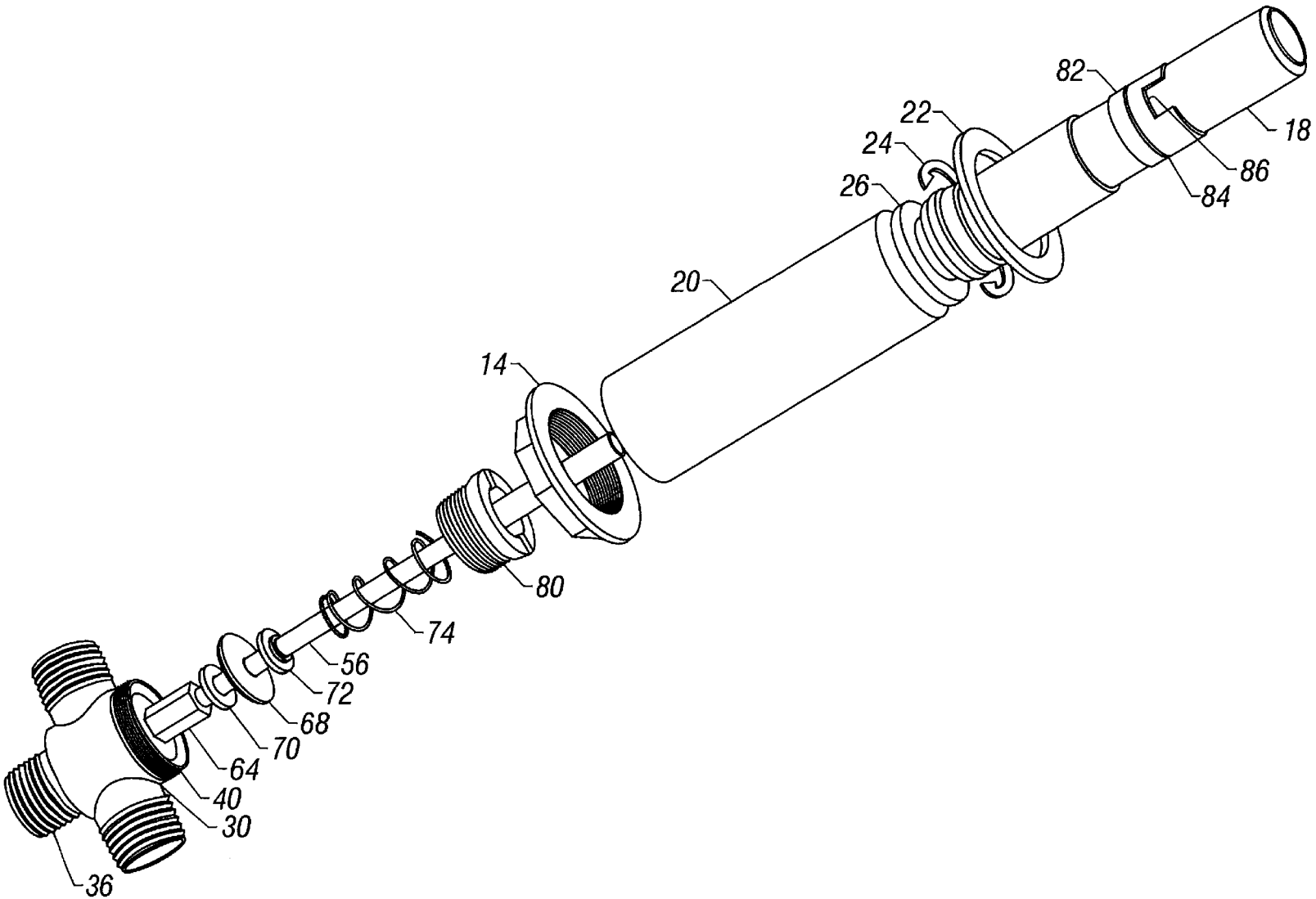
FIG. 2 is an exploded perspective of the height adjustable diverter spout assembly.

Focusing on FIGS. 2 and 3, the diverter assembly includes a spout interface 18 and a diverter sleeve 20. The diverter sleeve 20 has an exterior thread 21 to receive the threaded mounting nut 14. In assembly, the mounting nut 14 will be threaded fast up against the bottom of the sink deck 10, with a mounting washer 22 and a mounting clip 24 being used to secure the assembly 12 from the upper side of the deck 10. As shown particularly in FIG. 2, the clip 24 will extend into a groove 26 in the diverter sleeve 20 and it will overlie the washer 22, thus the clip and the washer secure the diverter assembly from the top and the nut 14 secures it from the bottom.

Figure 4:
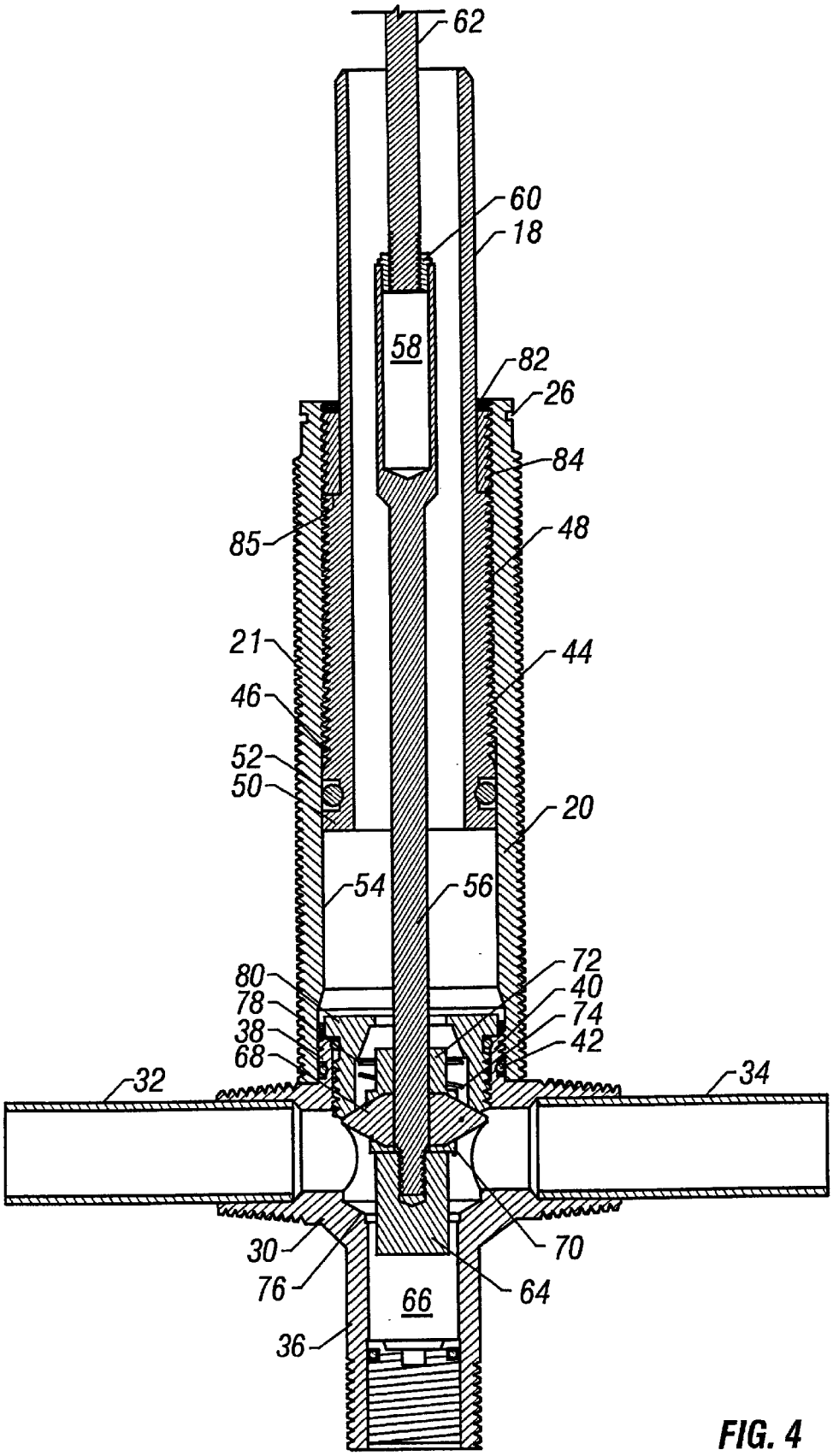
FIG. 4 is a vertical section through the height adjustable diverter spout assembly.

A diverter body is indicated at 30 and will have a hot water inlet conduit 32 and a cold water inlet conduit 34 connected thereto, as shown particularly in FIG. 4. At the bottom of the diverter body 30 there is a diverter outlet 36 which will direct water to a water discharge apparatus other than the spout 16, for example, a hand-held spray hose or the like.

The diverter sleeve 20 has an internal lower thread 38 which co-acts with an exterior threaded upwardly-extending boss 40 on the diverter body. There is a seal ring 42 where these elements are joined together. In this manner, the diverter sleeve is attached to the diverter body.

A portion of the interior surface of the diverter sleeve is threaded, as at 44, with this threaded section terminating in a shoulder 46. Positioned within the diverter sleeve is the spout interface 18 which has an exterior thread 48 which interacts with the interior thread 44 on the diverter sleeve to permit the spout interface to be telescopically vertically adjustable relative to the diverter sleeve. This vertical adjustment will acconmmodate varying thickness in the tub deck 10. The interior end of the spout interface 18 includes a flange 50 having a seal ring 52 which bears against the interior smooth surface 54 of the diverter sleeve. The shoulder 46 functions as a stop limiting upward movement of the spout interface once the flange 50 has contacted the shoulder. Thus, it is impossible to remove the spout interface in an upward direction by attempting to adjust it to an excessive height above the tub deck.

Positioned within the interior of the spout interface and the diverter sleeve is the diverter which comprises a diverter rod 56 having a socket 58 at its upper end, with the socket including a threaded nut 60. Threaded into the nut 60 is a lift rod 62 which has a threaded end which interacts with the nut 60. This permits vertical adjustment of the lift rod relative to the diverter rod after assembly.

At its lower end the diverter rod 56 is threaded into a diverter rod nut 64 having a hexagonal exterior surface, as shown in FIG. 2. This hexagonal surface will extend within an oval shaped slot 66 in the diverter body, which thus prevents rotation of the diverter rod nut, and thus the diverter rod, but permits the flow of water about the exterior of the diverter rod nut through the discharge passage 36.

The diverter assembly further includes a diverter seal 68 held to the diverter rod 56 by a lower seal washer 70 and an upper seal washer 72. A spring 74 encircles the assembly and normally biases the diverter toward a closing position, rather than the open position illustrated in FIG. 4. When the diverter is in the closed position, the diverter seal 68 will be closed upon a seat 76 in the diverter body. The upper end of the spring 74 will bottom against a should 78 in a diverter cap 80. The cap will be threaded into the diverter body, as illustrated in FIG. 4.

In use, the first step is to mount the diverter assembly to the tub deck 10. The spout interface will be pushed up through an appropriate opening in the tub deck at a height which would accommodate attachment of the spout 16. The mounting washer 22 will be placed about the spout interface and then the clip 24 will be positioned in the groove 26 so that the assembly is secured from the top to the tub deck. The mounting washer 14 will then be screwed up against the bottom of the tub deck to complete the rough-in attachment. At this point in time the lift rod has not been assembled to the diverter and the spout has not been attached. At this point a jam nut 82, which has a threaded section 84, is slid onto the exterior of the spout interface and pushed down by an appropriate tool until its exterior threads interact with the interior threads 44 on the diverter sleeve and the jam nut extends in a distance where it bottoms upon a shoulder 85 on the spout interface. This prevents someone from pushing on the top of the spout interface and having it turn down into the diverter sleeve to the point where the spout could not be attached to it.

If no decorative surface is to be further added to the tub deck 10 the spout may be attached by a suitable set screw, after which the lift rod 62 will extend down through the opening in the spout and will be threaded into the nut 60 a distance appropriate so that the lift rod will be located above the spout in a position to be grasped by a user. A special tool may be utilized to turn the jam nut in, as the nut has tool receiving openings 86 and the tool may also be used to properly gauge the height of the lift rod above the spout.

If a decorative surface is to be added to the tub deck before the spout is attached, the jam nut may be loosened by the use of the same tool, permitting height adjustment of the spout interface to accommodate the increased thickness of the tub deck. After so doing, the spout and lift rod will be assembled in the manner described previously.

Of particular advantage in the invention is the fact that the diverter sleeve, or spout nipple, as it is often termed, has a telescopic height adjustable spout interface which permits vertical adjustment of the location of the spout relative to the spout nipple after the spout nipple has been roughed in to the roman tub deck. Further, the lift rod is height adjustable relative to the diverter rod, again to accommodate a variation in the thickness of the roman tub deck.

Whereas the invention has been described particularly in connection with a roman tub, it is obvious that the use of an adjustable height spout nipple diverter assembly is equally suitable for other types of plumbing installations, with or without an accompanying diverter.

Whereas the preferred form of the invention has been shown and described herein, it should be realized that there may be many modifications, substitutions and alterations thereto.

What is claimed is:

1. A height adjustable water spout mounting assembly including a hollow sleeve having an external threaded surface and an internal threaded surface, a mounting nut threadably engapeable with the external threaded surface of the sleeve, a mounting washer surrounding the sleeve and a mounting clip engageable with the sleeve adjacent the mounting washer, the mounting nut, mounting washer and mounting clip cooperating to attach the sleeve to a spout mounting deck, a hollow spout interface formed and adapted to extend above the spout mounting deck and having an exterior surface, at least a portion of which is threaded, and sized to extend within and have its exterior threads interact with the interior threads on the sleeve for relative height adjustment of the spout interface with the spout mounting deck, the sleeve and spout interface defining a water passage therethrough, and a sleeve shoulder formed on one of the interior of the sleeve or the exterior of the spout interface for limiting outward movement of the spout interface relative to the sleeve.

2. The water spout mounting assembly of claim 1 wherein the mounting nut is threaded on the exterior of the sleeve and is adapted to be positioned below the sink deck and the mounting clip is adapted for attachment to the sleeve above the sink deck.

3. The water spout mounting assembly of claim 1 wherein the sleeve shoulder is on the interior surface of the sleeve, and the spout interface further comprises an outwardly extending flange on an exterior surface of the spout interface, said flange being enpaieable with the sleeve shoulder.

4. The water spout mounting assembly of claim 3 wherein the internal threaded surface of the sleeve terminates at the sleeve shoulder.

5. The water spout mounting assembly of claim 4 wherein the exterior thread on the spout interface terminates at the flange on the spout interface.

6. The water spout mounting assembly of claim 3 further including a seal ring mounted at said spout interface flange and sealing against the interior surface of said sleeve.

7. The water spout mounting assembly of claim 1 further including a jam nut engapeable with the spout interface for preventing rotation of the spout interface relative to the sleeve after mounting these elements to a spout mounting deck.

8. The water spout mounting assembly of claim 7 wherein said jam nut is slidable on an unthreaded portion of the exterior surface of the spout interface and the jam nut has threads thereon to interact with the interior threaded surface of the sleeve.

9. The water spout mounting assembly of claim 8 wherein said jam nut has tool receiving surfaces on an outward portion thereof.

10. The water spout mounting assembly of claim 1 further including a diverter body, said sleeve being attached to said diverter body and a diverter assembly extending coaxially within said sleeve and spout interface and having a portion thereof mounting a diverter member to interact with said diverter body.

11. The water spout mounting assembly of claim 10 wherein said diverter assembly includes a diverter rod, non-rotatably mounted within said diverter body, said rod carrying said diverter member, and a lift rod adjustably mounted to said diverter rod and extending outwardly from said spout interface and above the spout mounting deck.

12. The water spout mounting assembly of claim 11 wherein said diverter rod has a socket, with an internal threaded portion thereon, said lift rod having a portion with an exterior thread thereon, with the diverter rod threaded socket and the lift rod threaded portion providing for adjustable height mounting of the lift rod relative to the diverter rod.

13. The water spout mounting assembly of claim 11 further including a diverter rod nut having an exterior polygonal configuration, and a slot in said diverter body for receiving said nut and preventing rotation thereof.

* * * * *

UNITED STATES PATENT AND TRADEMARK OFFICE

CERTIFICATE OF CORRECTION

PATENT NO. : 6,668,393 B1
DATED : December 30, 2003
INVENTOR(S) : Nicholas A. Mascari and Martin Zummersch It is certified that error appears in the above-identified patent and that said Letters Patent is hereby corrected as shown below:

Column 4,
Lines 12 and 50, please delete “engapeable” and insert -- engageable --
Line 39, please delete “enpaieable” and insert -- engageable --

Signed and Sealed this

Ninth Day of November, 2004

JON W. DUDAS
*Director of the United States Patent and Trademark Office*